US008955253B2

(12) United States Patent
Kanki et al.

(10) Patent No.: US 8,955,253 B2
(45) Date of Patent: Feb. 17, 2015

(54) SENSOR FOR USE WITH AUTOMATIC DOOR

(75) Inventors: Hisayuki Kanki, Kobe (JP); Toru Iriba, Kobe (JP); Shinya Ikeda, Kobe (JP); Yasutaka Kanda, Kobe (JP); Kenji Nishigaki, Kobe (JP); Yasuteru Kitada, Kobe (JP); Takashi Wada, Kobe (JP)

(73) Assignee: Nabtesco Corporation, Tokyo (JP)

( * ) Notice: Subject to any disclaimer, the term of this patent is extended or adjusted under 35 U.S.C. 154(b) by 0 days.

(21) Appl. No.: 13/990,989

(22) PCT Filed: Nov. 25, 2011

(86) PCT No.: PCT/JP2011/077184

§ 371 (c)(1),
(2), (4) Date: May 31, 2013

(87) PCT Pub. No.: WO2012/073821

PCT Pub. Date: Jun. 7, 2012

(65) Prior Publication Data

US 2013/0255154 A1 Oct. 3, 2013

(30) Foreign Application Priority Data

Dec. 3, 2010 (JP) ..... 2010-270226

(51) Int. Cl.
*E05F 15/20* (2006.01)
*B66B 13/26* (2006.01)

(52) U.S. Cl.
CPC ..... *E05F 15/203* (2013.01); *B66B 13/26* (2013.01); *E05F 15/2023* (2013.01); *E05Y 2900/132* (2013.01)
USPC ..... 49/25

(58) Field of Classification Search
USPC ..... 49/25, 26, 28, 32
See application file for complete search history.

(56) References Cited

U.S. PATENT DOCUMENTS 4,560,912 A * 12/1985 Jonsson ..... 318/480
4,565,029 A * 1/1986 Kornbrekke et al. ..... 49/25
4,621,452 A * 11/1986 Deeg ..... 49/28
4,823,010 A * 4/1989 Kornbrekke et al. ..... 250/341.7

(Continued)

FOREIGN PATENT DOCUMENTS

JP 6-200672 7/1994
JP 10-274517 10/1998

(Continued)

OTHER PUBLICATIONS

International Search Report dated Jan. 5, 2012 from corresponding International Application No. PCT/JP2011/077184.

*Primary Examiner* — Katherine Mitchell
*Assistant Examiner* — Justin Rephann
(74) *Attorney, Agent, or Firm* — Duane Morris LLP

(57) ABSTRACT

A detecting unit (14) forms a plurality of detection spots arranged two-dimensionally on a floor surface near a door panel (12). Each detection spot is capable of detecting a human or an object by infrared light independently from other detection spots. Region distinguishing means (30) distinguishes a region formed by plural ones of the said detection spots that have detected the human or object. Person's movement judging means (44) judges the direction in which the distinguished region moves. A signal which causes a door panel (12) to be opened is supplied to a door controller (34) only when the direction of movement of the distinguished region is the direction toward the door panel.

7 Claims, 18 Drawing Sheets

(56) References Cited

U.S. PATENT DOCUMENTS

| | | | | |
|---|---|---|---|---|
| 4,866,881 | A * | 9/1989 | Morrow et al. | 49/25 |
| 4,893,852 | A * | 1/1990 | Harris et al. | 292/251.5 |
| 4,914,859 | A * | 4/1990 | Gionet et al. | 49/25 |
| 4,967,083 | A * | 10/1990 | Kornbrekke et al. | 250/341.7 |
| 5,142,152 | A * | 8/1992 | Boiucaner | 250/341.7 |
| 5,963,000 | A * | 10/1999 | Tsutsumi et al. | 318/480 |
| 6,051,829 | A * | 4/2000 | Full | 250/221 |
| 6,167,991 | B1 * | 1/2001 | Full et al. | 187/317 |
| 6,205,710 | B1 * | 3/2001 | Busse | 49/27 |
| 6,255,791 | B1 * | 7/2001 | Ariav | 318/282 |
| 6,329,774 | B1 * | 12/2001 | Ariav | 318/282 |
| 6,678,999 | B2 * | 1/2004 | Zengguang et al. | 49/25 |
| 6,782,660 | B2 * | 8/2004 | Takada et al. | 49/25 |
| 7,009,168 | B2 * | 3/2006 | Matsuyama et al. | 250/221 |
| 8,258,455 | B2 * | 9/2012 | Kakuyama et al. | 250/221 |
| 8,450,678 | B2 * | 5/2013 | Sasaki et al. | 250/221 |
| 8,510,990 | B2 * | 8/2013 | Agam et al. | 49/28 |

FOREIGN PATENT DOCUMENTS

| | | | |
|---|---|---|---|
| JP | 1999-311060 | A | 11/1999 |
| JP | 2000-356334 | | 12/2000 |
| JP | 2002-131450 | | 5/2002 |
| JP | 2003-51076 | | 2/2003 |
| JP | 2006-65886 | | 3/2006 |
| JP | 2006-225874 | | 8/2006 |
| JP | 2007-277829 | A | 10/2007 |
| JP | 2011-215122 | | 10/2011 |

* cited by examiner

SENSOR FOR USE WITH AUTOMATIC DOOR

TECHNICAL FIELD

This invention relates to a sensor for use with an automatic door and, more particularly, to such sensor using a plurality of two-dimensionally arranged detection areas.

BACKGROUND ART

Patent Literature 1 discloses an example of a sensor for use with an automatic door having a plurality of two-dimensionally arranged detection areas. According to the technology disclosed in Patent Literature 1, light emitting means is used to project spotlight to form spots of light in a matrix on a floor near a door of an automatic door system. Light reflected from each of the light spots on the floor is received by light-receiving means. If light from any one or more of the light spots is interrupted, it is judged that a human is detected, and the door is opened based on the judgment.

PRIOR ART LITERATURES

Patent Literature

Patent Literature 1: JP 2007-277829A
Patent Literature 2: JP 1999-311060A

SUMMARY OF INVENTION

Technical Problem

According to the guidelines for automatic door safety (sections for sliding-type automatic doors) drawn up by Japan Automatic Door Association for the purpose of improving safety of users passing through automatic sliding doors, the depth of a detection area of a sensor for use with automatic doors (i.e. a detection range over which the sensor can detect continuously, or for a given time period when the door is opened or closed, a person present near the path along which the door panel moves) should be 1,000 mm or more from a line extending through the center in the thickness direction of the door panel, and the ends in the width direction of the detection area should be 150 mm or more outward of the outer ends of the effective opening width of the door panel (i.e. the width of the opening of the automatic door through which people can pass). Like this, the detection area is relatively large, so, even when a person having no intention to pass through the automatic door walks along the door panel, the door panel may undesirably be opened or kept open. In such case, if control of temperature within a building with the automatic door system installed therein is achieved by means of air-conditioning equipment, it may be undesirably degraded. Also, the stillness in the building may be degraded. Thus, use of the above-described effective opening width may lead to increase of burden on the environment. Unintentional opening of a door panel would be prevented by making the detection area when the door panel is closed, smaller than the detection area meeting the safety guidelines, and broadening the detection area when the door is open to the broadness meeting the safety guidelines. However, the time period between the detection of a person when the door panel is closed and the arrival of the person at the door is short, so it may happen that the door panel does not open even after the person has arrived at the door. It means that the door passableness is not good. It is noted that, in this case, too, once the door panel opens, the door panel is kept open as long as a person moves near and in parallel with the door panel.

The above-discussed problem would be solved by, for example, opening the door panel only when a person approaches the door panel, as disclosed in Patent Literature 2. According to the technology of Patent Literature 2, determination of direction for judging whether a person is approaching the door or not is done in the following manner. A plurality of light sensors are used to form a plurality of monitoring rows extending in parallel with a door panel and spaced from each other in the direction away from the door panel. Each monitoring row has monitoring regions spaced from each other in the direction along the door panel. It is judged that a person is approaching the door panel when monitoring rows having monitoring regions detecting the person successively change from ones remoter from the door panel to ones nearer to the door panel. According to the above-discussed guidelines, the opposite ends of each monitoring row are 150 mm or more outward of the respective outer ends of the effective opening width. Accordingly, if a person is moving near outer ends of the monitoring rows toward a wall on either side of the door panel, not toward the center of the door panel, he or she may be erroneously judged as if he or she were approaching the door panel.

An object of the present invention is to provide a sensor for use with an automatic door which meets the provisions of the above-discussed guidelines and which does not erroneously judge as if a person or an object not approaching the door panel were approaching the door panel, whereby the passableness of automatic doors can be secured and the burden on the environment can be reduced.

Solution to Problem

A sensor for use with an automatic door sensor according to one embodiment of the present invention has detecting means. The detecting means forms a plurality of two-dimensionally arranged detection spots on a floor near a door. The detection spots can each detect independently a person or an object by the use of infrared light. (In this specification, a person or an object passing by the door or going to pass through the door is referred to simply as person.) The detecting means may be formed of, for example, infrared light emitting means and infrared light receiving mean, or it may be formed of infrared light receiving means only. The detecting means may be installed on a lintel or on a ceiling. Each detection spot has an area equal to or smaller than the area of a projection of a person or an object cast on the floor. Thus, a person or an object is detected simultaneously by a plurality of adjacent detection spots less than the total number of the detection spots or by a single detection spot. As a person or an object moves, a different detection spot(s) detects the person or the object. Distinguishing means distinguishes a region formed by the detection spots which detect the person or an object, out of all the detection spots. Judging means judges the direction in which the thus distinguished region moves. Output means output a signal to open the door only when the direction of the movement of the distinguished region is the direction toward the door.

A sensor for use with an automatic door having the described arrangement does not judge whether there is a person or an object in a monitoring row extending in parallel with the door, but it distinguishes a region formed of a single or plural detection spots detecting the person or the object and two-dimensionally determines the direction of movement of the distinguished region. Accordingly, it never happens that a person or an object moving toward a wall by the door is judged to be moving toward the door, and, thus, can reduce burden on the environment.

The judging means may be arranged to determine the direction of movement of the distinguished region by computation on the basis of the center of gravity of the distinguished region. Since the direction of movement is determined based on change of the center of gravity of the distinguished region, correct determination of direction of movement can be made regardless of changes with time of the shape of the distinguished region and the number of the detection spots forming the region.

The output means may be arranged to output the signal to open the door when it can be predicted, on the basis of the center of gravity of the distinguished region and the velocity of movement of the center of gravity computed from the temporal change of the center of gravity, that the center of gravity can pass through the opening of the door within a predetermined time. With such arrangement, the time during which the door is open can be minimized, and the burden on the environment can be further reduced accordingly.

The output means may be arranged to provide the signal to open the door when the center of gravity of the distinguished region keeps stopping in a predetermined area close to the door (i.e. when the center of gravity can be judged to be substantially standing still time-sequentially for a predetermined time). Also, the output means may be arranged to provide the signal to open the door when the center of gravity of the distinguished region is in a predetermined area close to the door (not in time sequential, but at a certain moment). With these arrangements, when it happens that the moving direction of a person or an object cannot be determined (this being highly probable when the person or the object keeps stopping or present in the predetermined area close to the door), the passableness of the door of the person or the object that is going to pass through the door can be secured.

The predetermined area may be one that is preset in accordance with the width of the door opening. With this arrangement, the predetermined area can be narrow, while securing the door passableness, and, therefore, unnecessary door opening and closing can be avoided, resulting in reduction of the burden on the environment.

The center of gravity of the distinguished region may be the centroid of the distinguished region displaced toward the detecting means by a predetermined amount. For example, if the detecting means is mounted on the lintel of the door, where the detecting means faces the floor, it may happen that a detection spot detects a shadow of a person or an object formed on the side of the person or the object opposite to the detecting means. If the centroid of the region distinguished by the distinguishing means from the detecting spots including the detection spot detecting such shadow is judged to be the center of gravity of the distinguished region, the position of the person or the object cannot be determined correctly. (For example, it may be judged as if it were remoter from the door.) This may cause the door opening operation to be delayed, or the door may be kept open for a time longer than necessary. In order to avoid the effects of a shadow, the centroid of the distinguished region displaced toward the detecting means is used as the center of gravity of the distinguished region.

The centroid of the distinguished region may be treated as the center of gravity of the distinguished region. For example, when the detecting means is mounted on the ceiling, no influence as discussed above is given to the system, and, therefore, the centroid of the distinguished region can be used as the center of gravity.

When there are plural distinguished regions, it may be so arranged that the distinguishing means distinguishes the respective regions independently, the judging means determines independently the directions in which the distinguished regions move, and the output means outputs the signal to open the door if the direction of any one of the independently distinguished regions is a direction toward the door.

With this arrangement, even when plural persons and/or objects are present near the door, the door opening and closing control can be done properly in response to the movement of such persons and/or objects.

DESCRIPTION OF EMBODIMENTS

Figure 1:
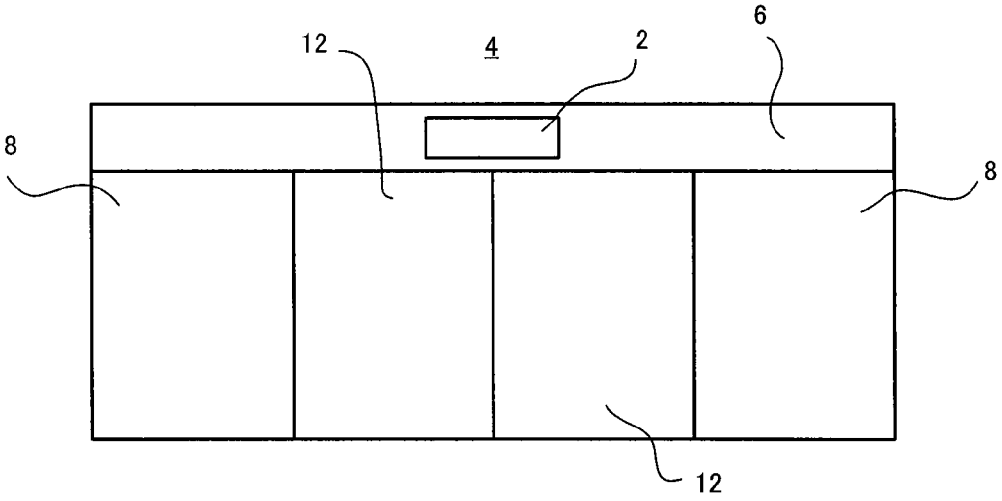
FIG. 1 is a front view of an automatic door including a sensor for use with the automatic door (hereinafter referred to as automatic door sensor or, simply, sensor) according to an embodiment of the present invention.

A sensor for use with an automatic door according to a first embodiment of the present invention is mounted on a lintel 6 of an automatic door 4 as shown in FIG. 1. The automatic door 4 has door panels 12, 12 by which a door opening 10 (see FIG. 3) formed between fixed walls 8, 8, being spaced from each other, is opened and closed. The door panels 12, 12 close the door opening 10 by sliding from the respective positions on the fixed wall 8 sides toward the center of the door opening, and open the door opening 10 by sliding from the positions on the door-opening center side toward the fixed walls 8, 8.

Figure 4:
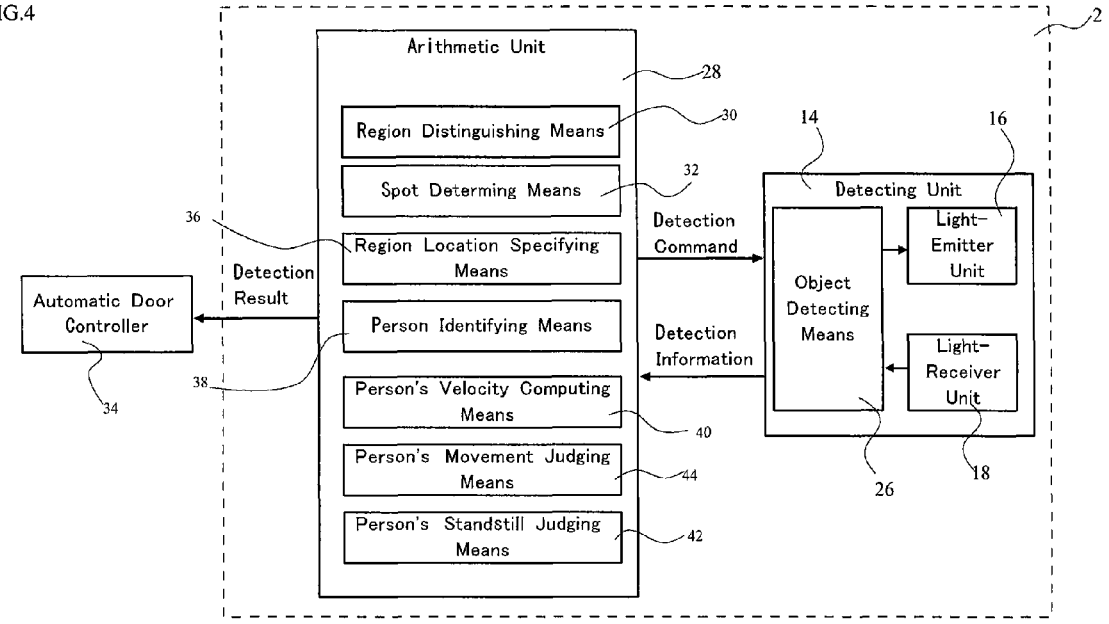
FIG. 4 is a block diagram of the automatic door sensor of FIG. 1.

As shown in FIG. 4, the automatic door sensor 2 has a detecting unit 14, which includes light-emitting means, e.g. a light-emitter unit 16, and light-receiving means, e.g. a light-receiver unit 18. The light-emitter unit 16 includes two light-emitters 16*a* and 16*b* arranged in a line and spaced from each other along the direction in which the door panels 12, 12 are opened and closed. The light-emitters 16*a* and 16*b* emit light, e.g. near infrared light pulsating at a predetermined frequency. The light-emitter 16*a* includes a matrix of twelve light-emitting devices (indicated by circled reference numerals 1 through 12 in FIG. 2(*a*)), formed by rows each including three light-emitting devices arranged along the direction of movement of the door panels 12, 12 and columns each including four light-emitting devices arranged along the height of the door panels 12, 12. The light-emitter 16*b* includes six light-emitting devices (indicated by circled reference numerals 13 through 18 in FIG. 2(*a*)), formed in rows each including three light-emitting devices arranged along the direction of movement of the door panels 12, 12 and in columns each including two light-emitting devices along the height of the door panels 12, 12. The light-emitting devices with the reference numerals 13 through 15 of the light-emitter 16*b* are disposed slightly lower than the light-emitting devices with the reference numerals 7 through 9 of the light-emitter 16*a*, and the light-emitting devices with the reference numerals 16 through 18 of the light-emitter 16*b* are disposed slightly lower than the light-emitting devices with the reference numerals 10 through 12 of the light-emitter 16*a*.

Figure 3:
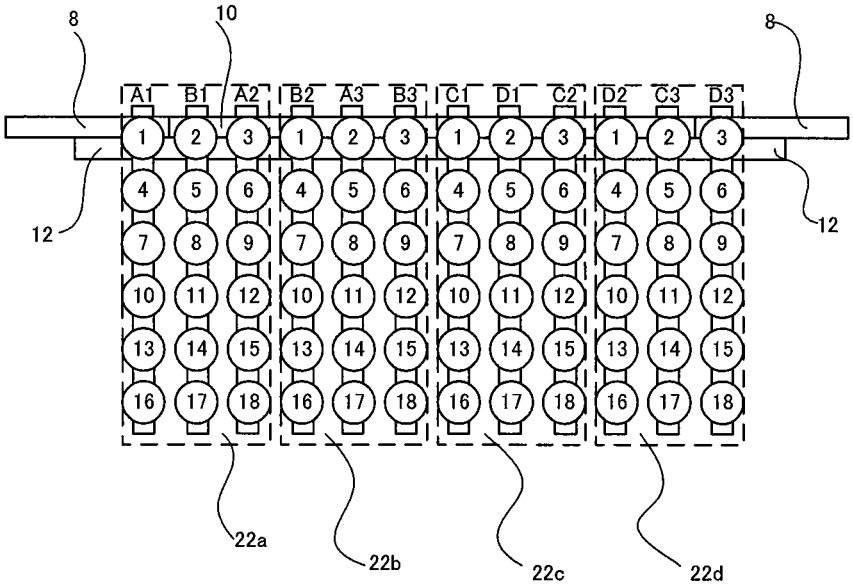
FIG. 3 is a plan view showing detection spots formed by the automatic door sensor of FIG. 1.

A plurality, corresponding to the number of the light-emitters 16*a* and 16*b*, two in this embodiment, of optical devices, e.g. segmented lenses 20*a* and 20*b* are disposed in front of the light-emitters 16*a* and 16*b*, respectively. Each of the segmented lenses 20*a* and 20*b* is segmented into four segments having their optical axes disposed at different angles with respect to the width direction of the door opening (i.e. the direction of movement of the door panels 12, 12). As a result, as shown in FIG. 3, four detection areas 22*a* through 22*d* are formed on a reference plane, e.g. a floor, by light from the eighteen light-emitting devices of the light-emitters 16*a* and 16*b*. Each of the detection areas 22*a* through 22*d* consists of eighteen detection spots. Circles in the detection areas 22*a* through 22*d* shown in FIG. 3 are the detection spots, and reference numerals in each detection area represent the light-emitting devices emitting light which forms the detection spots. There are formed twelve detection spots arranged along the width of the door opening by six detection spots arranged in lines in the direction perpendicular to the twelve detection spots on the floor, totaling to seventy-two detection spots. Each of the detection spots is of about the same size as or smaller than an area of a shadow of a person or an object that will probably pass through the detection areas 22*a* through 22*d*. The detection areas 22*a* through 22*d* are arranged in a line along the width of the door opening, and extend perpendicular to the height of the door panels 12, 12 and the width of the door opening.

Figure 2:
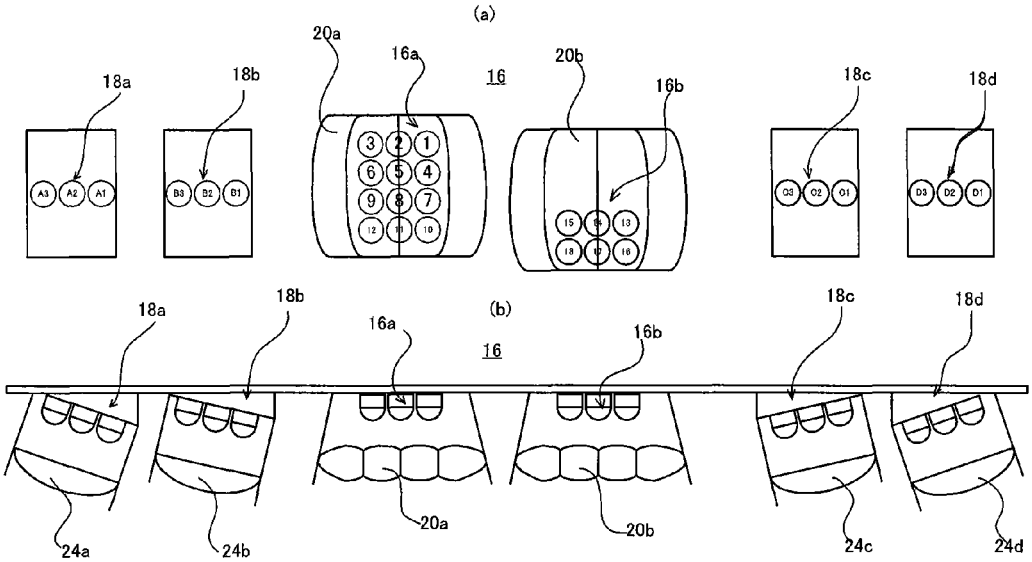
FIG. 2 shows a front and plan views of the automatic door sensor of FIG. 1.

As shown in FIG. 2, two of light-receivers 18*a* through 18*d* of a light-receiver unit 18 are disposed on each of the opposite sides of the light-emitter unit 16 on a line along the width of the door opening. Each of the light-receivers 18*a* through 18*d* has three light-receiving devices arranged in a line along the width of the door opening. In FIG. 2(*a*), references A1 through A3 in circle represent light-receiving devices of the light-receiver 18*a*, references B1 through B3 in circle represent light-receiving devices of the light-receiver 18*b*, references C1 through C3 in circle represent light-receiving devices of the light-receiver 18*c*, and references D1 through D3 in circle represent light-receiving devices of the light-receiver 18*d*. The total number of the light-receiving devices is twelve, which is equal to the number of the above-described detection spots arranged in a line along the width of the opening.

In front of the respective light-receivers 18*a* through 18*d*, optical devices, e.g. cylindrical lenses 24*a* through 24*d* are disposed. Each of the cylindrical lenses 24*a* through 24*d* acts to condense light from different locations along the width of the door opening onto a same light-receiver. By virtue of the action of the cylindrical lens 24*a*, light reflected from six detection spots shown within a frame with a reference A1 in FIG. 3 impinges onto the light-receiving device A1. Similarly, light reflected from six detection spots shown within a frame with a reference A2 in FIG. 3 impinges onto the light-receiving device A2 by virtue of the action of the cylindrical lens 24*a*. Light reflected from six detection spots shown within a frame with a reference A3 in FIG. 3 impinges onto the light-receiving device A3 by virtue of the action of the cylindrical lens 24*a*. In a similar manner, each of the cylindrical lenses 24*b* through 24*d* causes light reflected from the six detection spots within a frame with corresponding one of references B1 through D3 in FIG. 3 to impinge onto corresponding one of the light-receiving devices B1 through D3. The detection spots are disposed in such a density that there should be no region where an object cannot be detected. The range in which each detection area composed of the detection spots extends when the door is closed can differ from the one when the door is open, only if the guidelines are met at least when the door is open.

Figure 5:
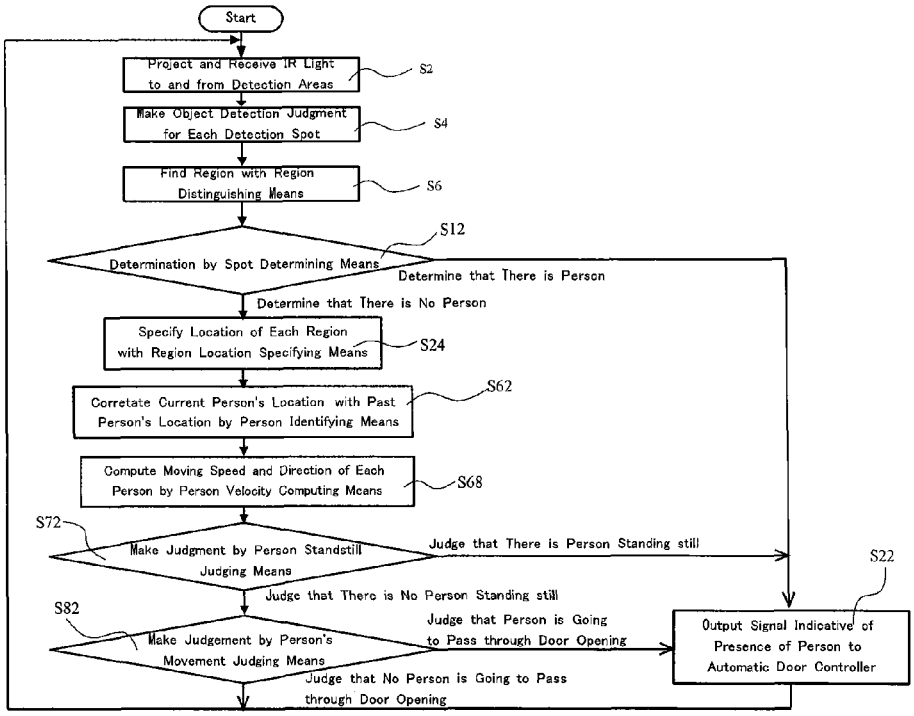
FIG. 5 is a main flow chart illustrating the operation of the automatic door sensor of FIG. 1.

Object detecting means 26 of the detecting unit 14 controls the light-emitter unit 16 and the light-receiver unit 18 in such a manner as shown in FIG. 5 that light is projected onto and received from the respective detection areas 22*a* through 22*d* (Step S2).

Specifically, the eighteen light-emitting devices of the light-emitter 16*a* and 16*b* repeat emitting light successively, one at each time, in a time division fashion. In other words, the light-emitting devices with references 1 through 18 attached thereto as shown in FIG. 2 repeat emitting light successively one at each time from the light-emitting device 1 through the light-emitting device 18. In synchronization with the light emission of the eighteen light emitting devices of the light-emitters 16*a* and 16*b*, the light-receiving devices A1 through D3 of the light-receivers 18*a* and 18*d* are successively enabled to receive light one by one from the light-receiving device A1 through B1, A2, B2, A3, B3, C1, D1, C2, D2, and C3 to the light-receiving device D3. This successive enablement is repeated.

Then, first the light-receiving device A1 receives light reflected from the detection spot with the reference 1 attached thereto in the detection area 22*a*, the light-receiving device B1 receives light reflected from the detection spot with the reference 2 attached thereto in the detection area 22*a*, and the light-receiving device A2 receives light reflected from the detection spot with the reference 3 attached thereto in the detection area 22*a*. After that, the light-receiving device B2 receives light reflected from the detection spot with the reference 1 attached thereto in the detection area 22*b*, the light-receiving device A3 receives light reflected from the detection spot with the reference 2 attached thereto in the detection area 22*b*, and the light-receiving device B3 receives light reflected from the detection spot with the reference 3 attached thereto in the detection area 22*b*. The light-receiving device C1 receives light reflected from the detection spot with the reference 1 attached thereto in the detection area 22*c*, the light-receiving device D1 receives light reflected from the detection spot with the reference 2 attached thereto in the detection area 22*c*, and the light-receiving device C2 receives light reflected from the detection spot with the reference 3 attached thereto in the detection area 22*c*. Then, the light-receiving device D2 receives light reflected from the detection spot with the reference 1 attached thereto in the detection area 22*d*, the light-receiving device C3 receives light reflected from the detection spot with the reference 2 attached thereto in the detection area 22*d*, and the light-receiving device D3 receives light reflected from the detection spot with the reference 3 attached thereto in the detection area 22*d*.

The light-receiving device A1 receives again light reflected from the detection spot with the reference 4 attached thereto in the detection area 22*a*, the light-receiving device B1 receives light reflected from the detection spot with the reference 5 attached thereto in the detection area 22*a*, and the light-receiving device A2 receives light reflected from the detection spot with the reference 6 attached thereto in the detection area 22*a*. Next, the light-receiving device B2 receives light reflected from the detection spot with the reference 4 attached thereto in the detection area 22*b*, the light-receiving device A3 receives light reflected from the detection spot with the reference 5 attached thereto in the detection area 22*b*, and the light-receiving device B3 receives light reflected from the detection spot with the reference 6 attached thereto in the detection area 22*b*. The light-receiving device C1 receives light reflected from the detection spot with the reference 4 attached thereto in the detection area 22*c*, the light-receiving device D1 receives light reflected from the detection spot with the reference 5 attached thereto in the detection area 22*c*, and the light-receiving device C2 receives light reflected from the detection spot with the reference 6 attached thereto in the detection area 22*c*. Then, the light-receiving device D2 receives light reflected from the detection spot with the reference 4 attached thereto in the detection area 22*d*, the light-receiving device C3 receives light reflected from the detection spot with the reference 5 attached thereto in the detection area 22*d*, and the light-receiving device D3 receives light reflected from the detection spot with the reference 6 attached thereto in the detection area 22*d*.

In a similar manner, reception of light reflected from the seventy-two in total of detection spots by the light-receiving devices A1 through D3 in the light-receivers 18*a* through 18*d* is repeated.

Next, the object detecting means 26 makes object detection judgment (Steps S4) for each detection spot. If there is a person in one or more of the detection areas 22*a* through 22*d*, light projected onto a plurality or one of adjoining detection spots is reflected or absorbed by the person, and, therefore, the amount of light received by the light-receiving devices A1 through D3 is different from the one when there is no person. By comparing the thus obtained amount of received light with a predetermined threshold value in the object detecting means 26, it can be judged in which ones or one of the detection spots a person is being detected. The obtained detection information is supplied to an arithmetic unit 28. The arithmetic unit 28 and the object detecting means 26 can be realized by means of, for example, a CPU and storage means, e.g. a memory, storing programs to be executed by the CPU.

Figure 6:
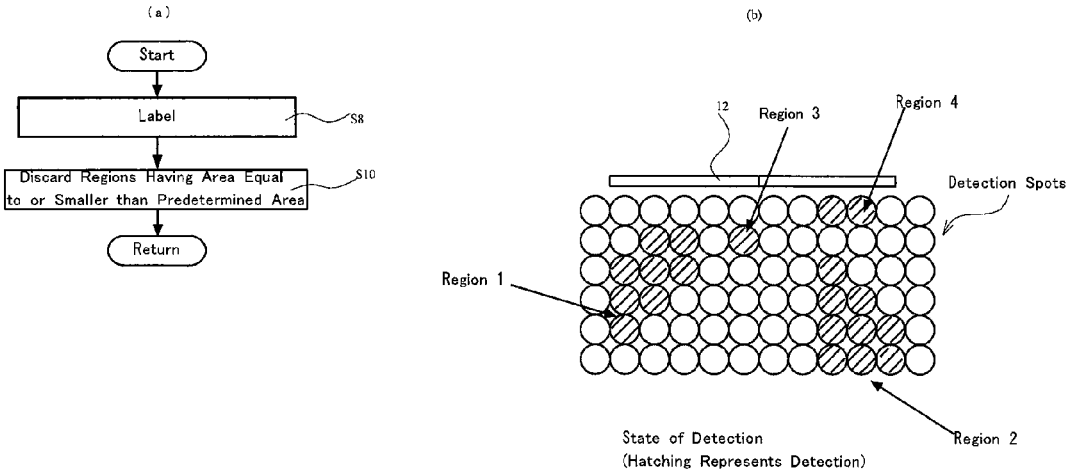
FIG. 6 is a flow chart illustrating the processing executed by region distinguishing means 30 shown in FIG. 4 and explanation about the processing.

Next, region distinguishing means 30 in the arithmetic unit 28 finds a region detecting an object (Step S6). Specifically, as shown in FIG. 6(*a*), labeling is done (Step S8). In the labeling step, a same label is attached to all of mutually linking detection spots out of detection spots which are judged to have detected a person, and a different label is attached to different mutually linking detection spots, as shown in FIG. 6(*b*). In FIG. 6(*b*), a region 1, a region 2, a region 3 and a region 4 are four mutually linking detection spots obtained by the labeling. Next, regions having an area equal to or smaller than a predetermined area (i.e. regions having detection spots equal to or smaller in number than a predetermined number) are discarded (Step S10). The reason why regions having an area equal to or smaller than a predetermined area are discarded is that the probability that they have not detected any person is large. When the predetermined area is set at an area for three detection spots, for example, the region 3 having an area of one detection spot and the region 4 having an area of two detection spots are discarded, and the regions 1 and 2 are distinguished as regions detecting an object. When the processing in Step S10 is finished, the region distinguishing processing is ended.

Figure 7:
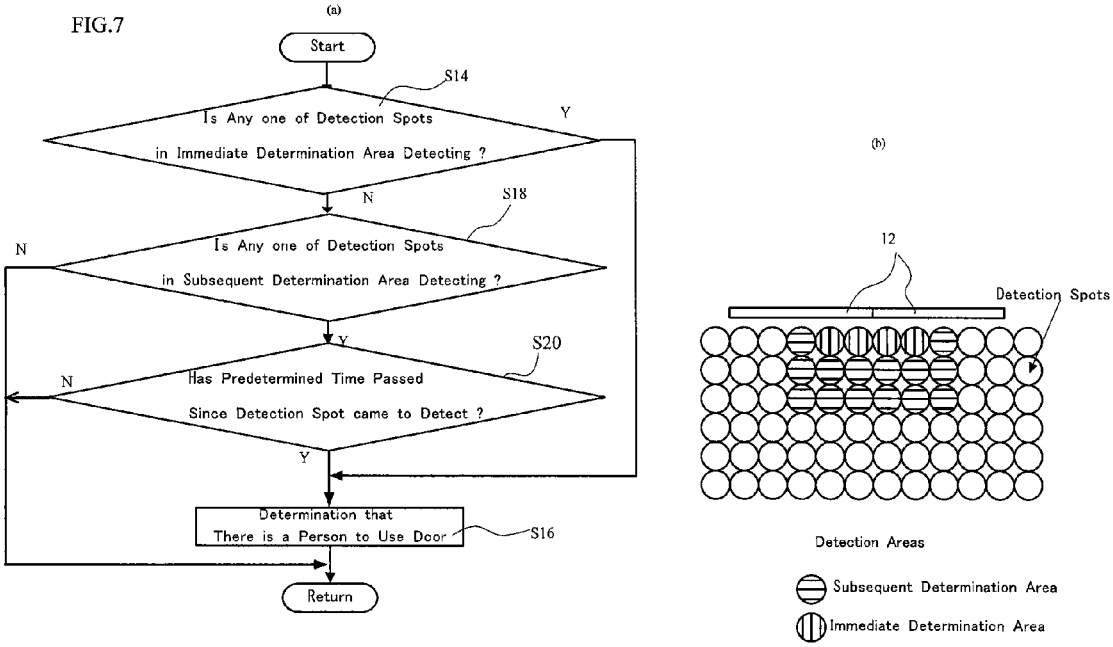
FIG. 7 is a flow chart illustrating the processing executed by spot determining means 32 shown in FIG. 4 and explanation about the processing.

Next, the spot determining means 32 in the arithmetic unit 28 makes determination as to whether there is a person or not, for each of the distinguished regions (Step S12). Specifically, a plurality, e.g. four, of adjoining detection spots nearest to the center of the door panels 12, 12 are predetermined as an immediate determination area for which the determination should be done immediately, and a plurality of subsequent determination areas surrounding the immediate determination area are also predetermined. See FIG. 7(*b*). Then, determination whether or not any one or more of the detection spots in the immediate determination area belong to the region distinguished by the region distinguishing means 30 is done (Step S14). If the determination is affirmative, it can be thought that a person is at a location close to the door panels 12, 12, that is, the person is waiting for the door to be opened, and, therefore, it is judged that there is a person who is going to pass through the door (Step S16). If the determination made in Step S14 is negative, determination whether or not any one or more of the detection spots in the subsequent determination area belong to the region distinguished by the region distinguishing means 30 is done (Step S18). If the determination made in Step S18 is negative, it can be judged that there is a person in neither the immediate determination area nor the subsequent determination area, and the spot determination processing ends. If the determination made in Step S18 is affirmative, then, whether a predetermined time has passed since the detection spot in the subsequent determination area came to belong to the region distinguished by the region distinguishing means 30 is judged (Step S20). If the judgment in Step S20 is affirmative, it can be judged that there is a person standing still near the door panels 12 for the predetermined time, and, therefore, it is judged in Step S16 that there is a person intending to pass through the door. Then, the spot determination processing is ended.

When the spot determining means 32 judges that there is a person going to pass the door opening, in the above-described manner, the arithmetic unit 28 outputs a signal indicative of the presence of the person to a door controller 34 (Step S22). This causes the door panels 12, 12 to open. After Step S22 is ended, Step S2 is executed again. Step S22 is the output means.

Figure 8:
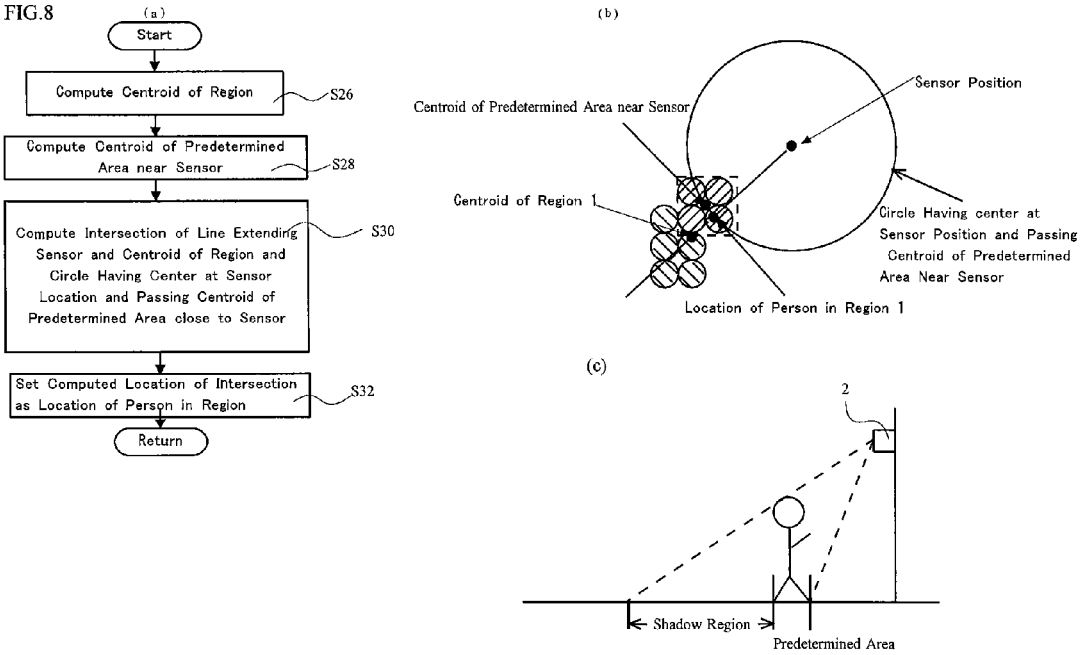
FIG. 8 is a flow chart illustrating the processing executed by region location specifying means 36 shown in FIG. 4 and explanation about the processing.

If the spot determining means 32 judges that there is no person, region location specifying means 36 in the arithmetic unit 28 specifies the locations of each region (Step S24). Specifically, as shown in FIG. 8(*a*), the centroid of each region is computed (Step S26). For example, the centroid of each of the detection spots forming a region 1 is computed, as shown in FIG. 8(*b*). Next, the centroid of a predetermined area in each region near the automatic door sensor 2 is computed (Step S28). For example, assuming that the predetermined area is equal to the area of four detection spots, the centroid location of the four detection spots close to the automatic door sensor 2 in the region 1 (i.e. the four detection spots in a region defined by a broken line in FIG. 8(*b*)) is computed. Next, as shown in FIG. 8(*b*), a straight line connecting the automatic door sensor 2 with the centroid of a region, e.g. the region 1, is drawn. Next, a circle having a center at the location of the automatic door sensor 2 and having a radius equal to the distance r between the automatic door sensor 2 and the centroid of the predetermined area is drawn, and the intersection of the circle and the straight line is computed (Step S30). The location of this intersection is set as the location of the person (Step S32). Thus, a location shifted toward the automatic door sensor 2 from the centroid of the region 1 is set as the location of the person or the center of gravity of the region. A similar processing is carried out for other regions.

When the automatic door sensor 2 is mounted on the lintel 6 as shown in FIG. 8(*c*), the light-emitter unit 16 and the light-receiver unit 19 are disposed to face slantwise toward the floor, and, therefore, the region distinguished by the region distinguishing means 30 includes a shadow formed on the side opposite to the automatic door sensor 2. If the computed centroid of the region including the shadow were set as the location of the person, the person's location set would contain an error (i.e. an error caused by setting, as the person's location, a location which is farther from the automatic door sensor 2 than the true location of the person). To avoid that, the above-discussed predetermined area is set at the location near to the automatic door sensor 2 within the region specified by the region location specifying means 36, on the basis of a size of a person which is thought to be an ordinary size, and, then, the centroid of the predetermined area is determined. It may happen, however, that the direction of the automatic door sensor 2 viewed from the predetermined area is different from the direction viewed from the person in subject. However, the direction of the automatic door sensor 2 viewed from the region including the person's shadow coincides with the direction of the automatic door sensor 2 viewed from the person intending to pass through the door, as is understood from FIG. 8(*b*). According to the descried arrangement, therefore, the position of the centroid of the predetermined area is shifted onto the line connecting the region including the person's shadow and the automatic door sensor 2, whereby the correct direction with respect to the automatic door sensor 2 can be secured. In the described arrangement, the size of the predetermined area is the area of four detecting spots, which has been determined on the basis of an ordinary size of a person going to use the door, and the centroid of the four detection spots is computed in the processing to secure the stability of position based on averaging. However, other than four detection spot centroid computation can be employed only if it is linked with the location of the person.

Figure 9:
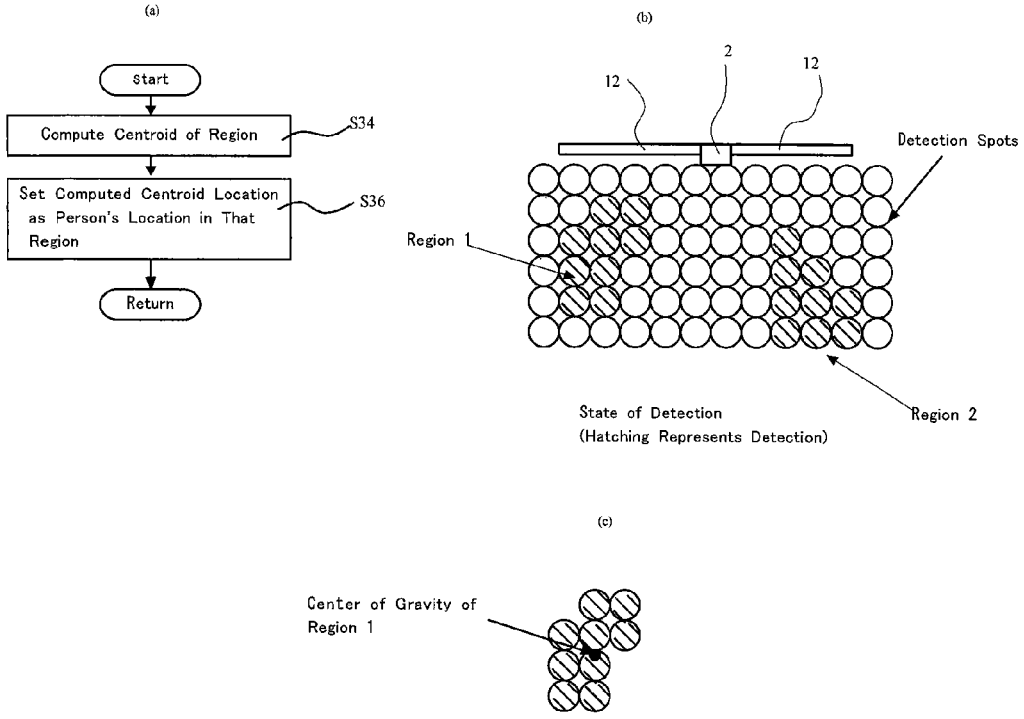
FIG. 9 is a flow chart illustrating the processing executed by another example 1 of the region location specifying means 36 and explanation about the processing.

In FIGS. 9(*a*) through 9(*c*), another example 1 of the region location specifying means 36 is shown. The region location specifying means 36 of Example 1 is used for the automatic door sensor 2 mounted on a ceiling, where a shadow described with reference to FIG. 8 is not contained in the distinguished region. In this case, therefore, the centroid computation for a region as shown in FIG. 9(*a*) is carried out (Step S34). In FIG. 9(*c*), the center of gravity of a region 1 is shown. In this case, the center of gravity of the region 1 is coincides with the centroid of the region 1. Then, the computed centroid location is set as the person's location in the region (Step S36). Where a plurality of regions are distinguished, as shown in FIG. 9(*b*), the processing of Steps S34 and S36 are carried out for all of the regions.

Figure 10:
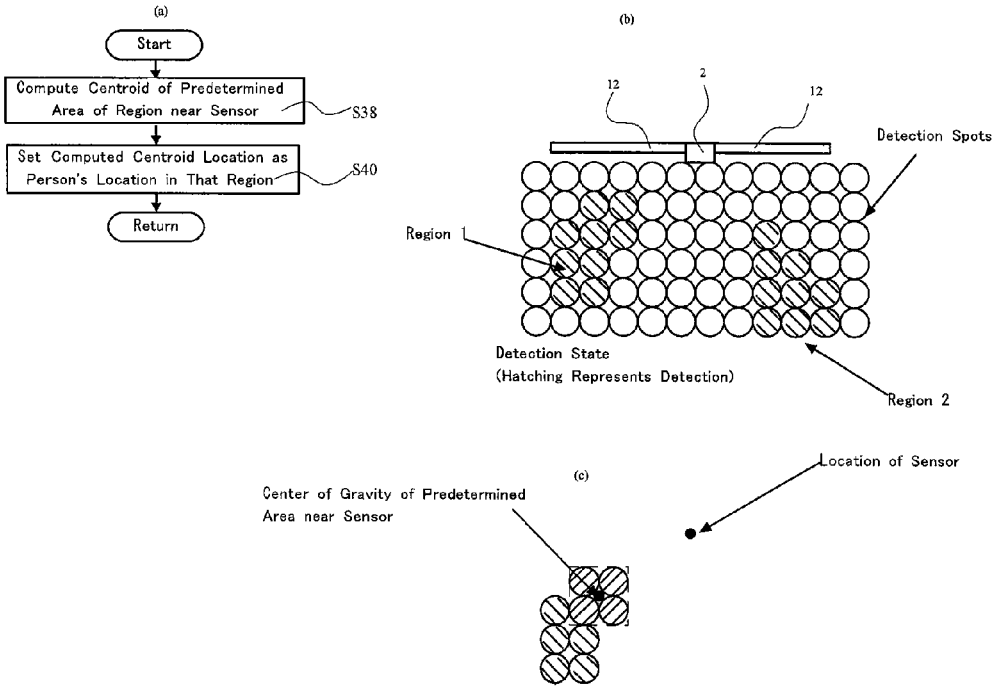
FIG. 10 is a flow chart illustrating the processing executed by still another example 2 of the region location specifying means 36 and explanation about the processing.

Another example 2 of the region location specifying means 36 is shown in FIG. 10(*a*) through 10(*c*). The region location specifying means 36 of Example 2 is used when the automatic door sensor 2 is mounted on the lintel 6. The centroid of a predetermined area of each region near to the automatic door sensor 2 is computed (Step S38). Assuming that the predetermined area is an area for four detection spots, the location of the centroid of the four detection spots near to the automatic door sensor 2 in a Region 1 (i.e. four detection spots within a broken line square in FIG. 10(*c*)) is computed, and the thus computed centroid location is set as the person's location (Step S40). As explained previously with reference to FIG. 8, the predetermined area is determined on the basis of a size of a human, and, therefore, it is highly probable that the center of gravity of the predetermined area is near the person's location (i.e. the location of the center of gravity of the person). Thus, the location of the person in the region can be computed relatively accurately and easily. Where a plurality of regions are distinguished as shown in FIG. 10(*b*), the above-described processing is carried out for each of the regions.

Figure 11:
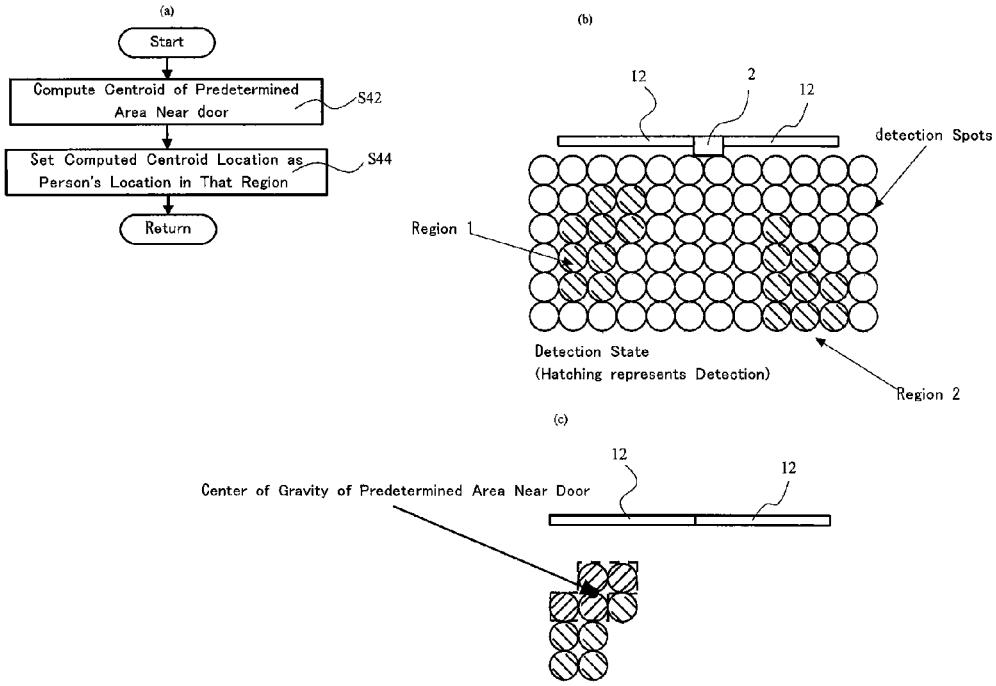
FIG. 11 is a flow chart illustrating the processing executed by still another example 3 of the region location specifying means 36 and explanation about the processing.

Example 3 of the region location specifying means 36 is shown in FIGS. 11(*a*) through 11(*c*). When this region specifying means is used, the automatic door sensor 2 is mounted on the lintel 6. Instead of the centroid of a predetermined area near the automatic door sensor 2 in each region, the centroid of a predetermine area near the door panels 12, 12 shown in a broken line square in FIG. 11(*c*) is computed (Step S42). The computed centroid location is set as the person's location in the region (Step S44). The predetermined area is determined on the basis of the size of a human, and therefore it is highly probable that the location of the centroid of the predetermined area is near the person's location (i.e. the location of the center of gravity of the person). Further, since judgment is made with reference to the door location (i.e. the door plane), the computation is simple and easy, and, still, it is possible to compute relatively accurately the person's location in the region. Where a plurality of regions are distinguished, as shown in FIG. 11(*b*), the processing of Steps S42 and S44 are carried out for all of the regions.

Figure 12:
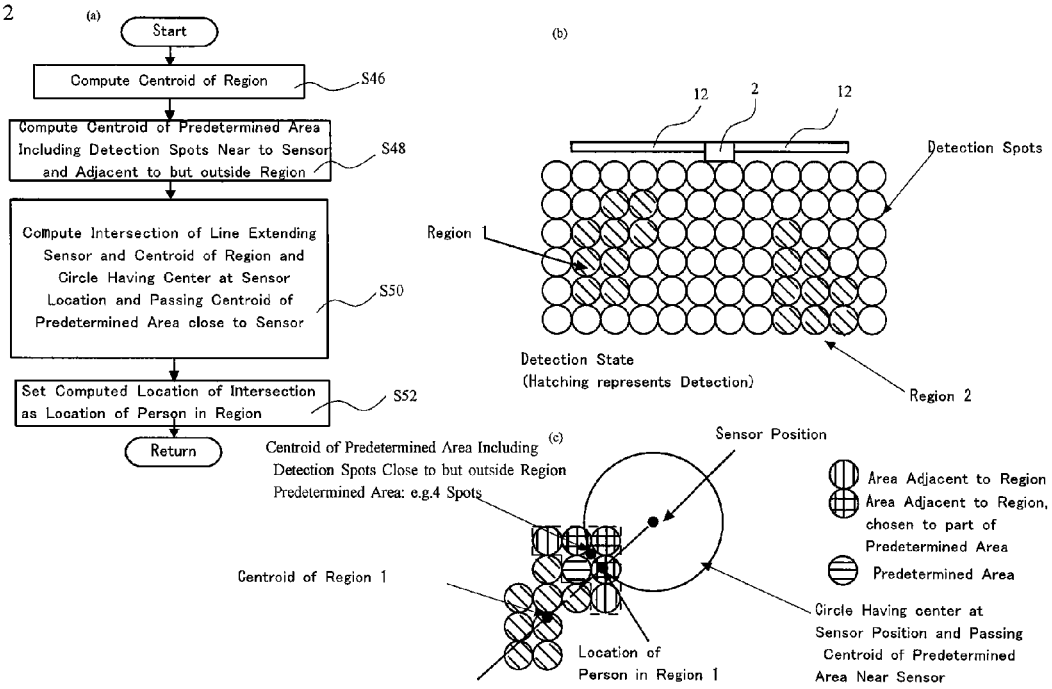
FIG. 12 is a flow chart illustrating the processing executed by still another example 4 of the region location specifying means 36 and explanation about the processing.

FIGS. 12(*a*) through 12(*c*) show another example 4 of the region location specifying means 36. When the region location specifying means 36 of this example 4 is used, the automatic door sensor 2 is on the lintel 6. In this region location specifying means 36, too, the centroid of each region is computed (Step S46), as shown in FIG. 12(*a*). Then, the centroid of a predetermined area, indicated by a broken line square in FIG. 12(*c*), including detection spots located close to the automatic door sensor 2 and adjacent to but outside the region of interest, is computed (Step S48). Next, as shown in FIG. 12(*c*), a straight line connecting the automatic door sensor 2 with the centroid of a region, e.g. the region 1, is drawn, a circle having a center at the location of the automatic door sensor 2 and having a radius equal to the distance R between the automatic door sensor 2 and the centroid of the predetermined area is drawn, and the intersection of the circle and the straight line is computed (Step S50).

The principle in computing the location of a person is generally the same as that in the case shown in FIG. 8, but, even when the detection spot sensitivity is lowered in comparison with the case of FIG. 8, the door can be properly opened because the location of the centroid of the predetermined area is computed with detection spots included in the predetermined area but not included in the region taken in the computation. Where a plurality of regions are distinguished, as shown in FIG. 12(*b*), the processing of Steps S46, S48, S50 and S52 are carried out for all of the regions.

Figure 13:
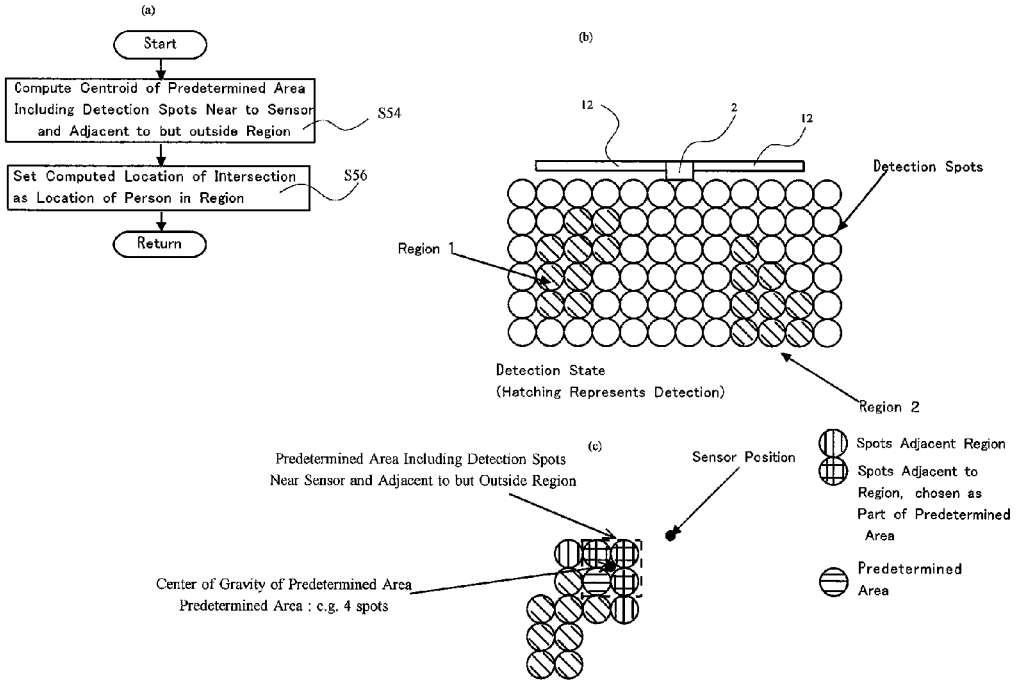
FIG. 13 is a flow chart illustrating the processing executed by still another example 5 of the region location specifying means 36 and explanation about the processing.

Another example 5 of the region location specifying means 36 is shown in FIGS. 13(*a*) through 13(*c*). When this region location specifying means 36 of this example is used, the sensor 2 for use with an automatic door is mounted on the lintel 6. Like the one shown in FIG. 10, in this region location specifying means 36, too, the centroid of a predetermined area near the automatic door sensor 2 in each region is computed (Step S54). The predetermined area, as shown in a broken line square in FIG. 13(*c*), includes detection spots adjacent to but outside the region. The computed centroid location of the predetermined area is set as the person's location in the region (Step S56). With this arrangement, even when the detection spot sensitivity is lowered, or, in other words, even when the predetermined threshold value in the object detecting means 26 is raised in comparison with the case of FIG. 10, the door can be properly opened and closed because the location of the centroid of the predetermined area is computed, with detection spots included in the predetermined area but not included in the region taken in the computation. The reason why the sensitivity is lowered is to make it hard to detect persons as countermeasures against noise. It should be noted that, as shown in FIG. 13(*b*), where a plurality of regions are distinguished, the processing of Steps S54 and S56 are carried out for all of the regions.

Figure 14:
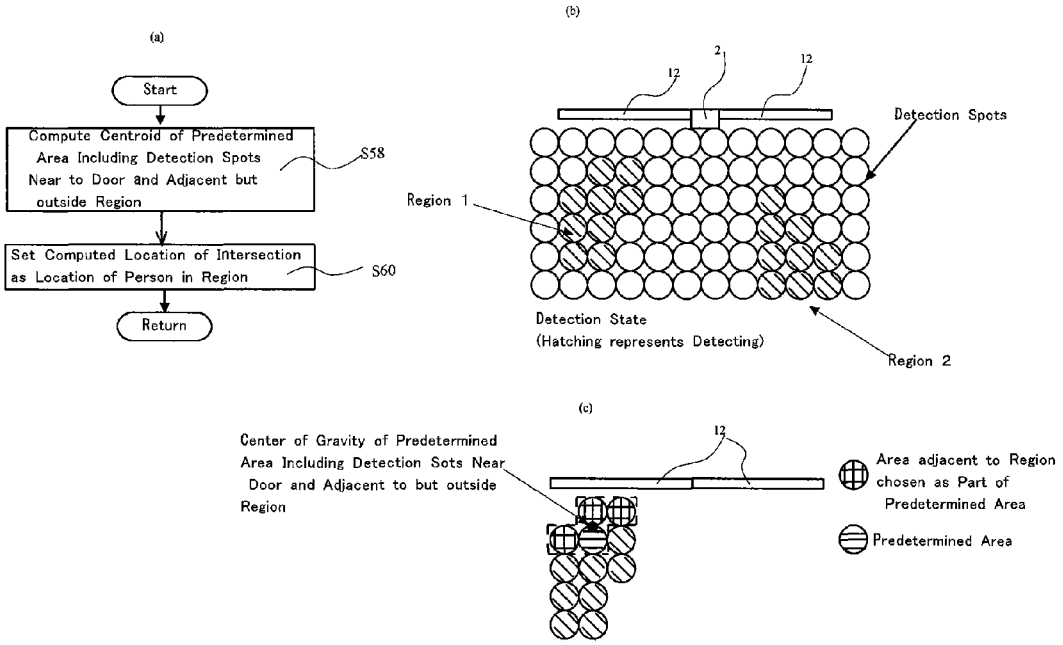
FIG. 14 is a flow chart illustrating the processing executed by still another example 6 of the region location specifying means 36 and explanation about the processing.

An example 6 of the region location specifying means 36 is shown in FIGS. 14(*a*) through 14(*c*). When the region location specifying means 36 of this example is used, the automatic door sensor 2 is mounted on the lintel 6. Like the one shown in FIG. 11, in the region location specifying means 36 of this example, the centroid of a predetermined area in a region near the door is computed (Step S58). The predetermined area includes detection spots nearer to the door panels 12, 12 and adjacent to but outside the region, as shown being placed in a broken line frame in FIG. 14(*c*). Then, the computed centroid location is set as the person's location in the region (Step S60). With this arrangement, since the location of the centroid of the predetermined area is computed with detection spots included in the predetermined area but not included in the region taken in the computation, the door can be properly opened and closed even when the sensitivity of the detection spots is lowered relative to the case of FIG. 11. It should be noted that, as shown in FIG. 14(*b*), where a plurality of regions are distinguished, the processing of Steps S58 and S60 are carried out for all of the regions.

Figure 15:
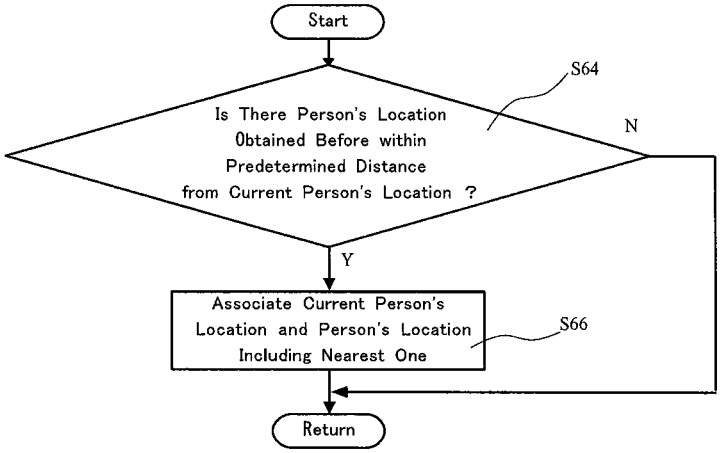
FIG. 15 is a flow chart illustrating the processing executed by person identifying means 38 shown in FIG. 4.

After the person's location is specified by the region location specifying means 36 in the above-described manner, person identifying means 38 in the arithmetic unit 28 correlates the current person's location with a past person's location, as shown in FIG. 5 (Step S62). Specifically, as shown in FIG. 15, it is judged whether there is a person's location obtained before within a predetermined distance from the current location of the person, as shown in FIG. 15 (Step S64). If the judgment is NO, the processing is ended, and, although not shown, Step S2 is executed again. If the judgment made in Step S64 is affirmative, person's locations including the person's location nearest to the current person's location is associated with the current person's location, and the processing is ended (Step S66). In case that a plurality of person's locations are specified, the correlation is carried out for each of the person's locations.

Figure 16:
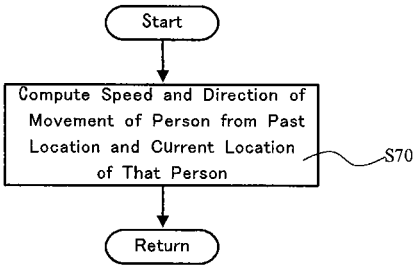
FIG. 16 is a flow chart illustrating the processing executed by person's velocity computing means 40 shown in FIG. 4.

After the correlation processing, person's velocity computing means 40 in the arithmetic unit 28 computes the speed and direction of movement of each person (Step S68). Specifically, the speed and direction of movement of a person of interest are computed on the basis of a past location of a person who is the person of interest and the current location of the person of interest (Step S70), as shown in FIG. 16.

Figure 17:
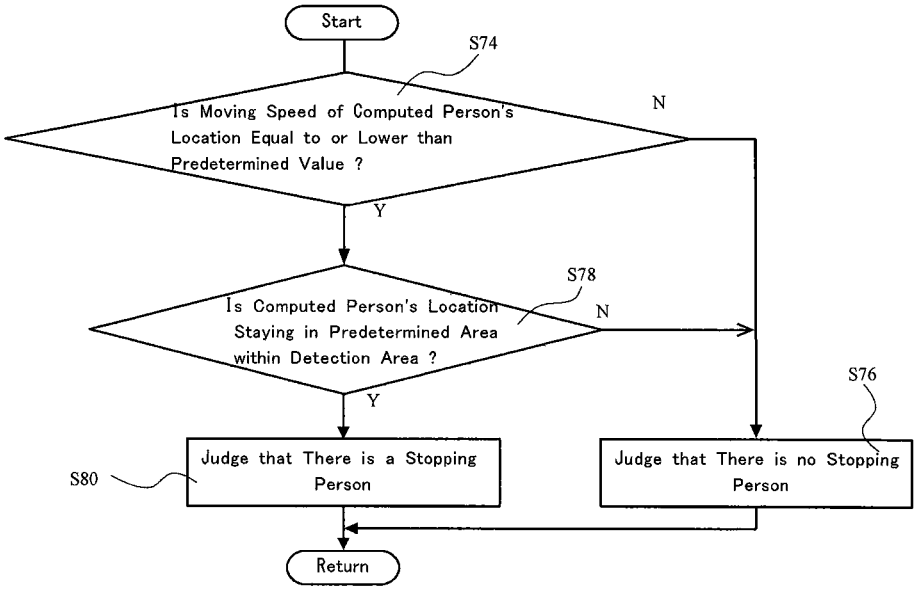
FIG. 17 is a flow chart illustrating the processing executed by person's standstill judging means 42 shown in FIG. 4.

After the speed and direction of movement of a person are computed in this manner, person's standstill judging means 42 in the arithmetic unit 28 judges whether the person of interest is standing still or not (Step S72), as shown in FIG. 5. Specifically, as shown in FIG. 17, whether the computed moving speed of the person's location is equal to or lower than a predetermined value is judged (Step S74). If the judgment is negative, it is judged that there is no person standing still (Step S76), and the processing is ended. If the judgment made in Step S74 is YES, there is a probability that a person standing still is present, and, therefore, whether the computed person's location is staying in a predetermined area within the detection area, e.g. near the door panels 12, 12, for more than a predetermined time period (Step S78). This predetermined area is determined depending on the width of the door opening 10, and may contain therein the previously discussed subsequent determination area and immediate determination area. If the judgment made in Step S78 is YES, it is judged that there is a person standing still (Step S80), and the processing is ended. If the judgment made in Step S78 is negative, Step S76 is executed and it is judged that there is no standing person.

If it is judged in Step S72 that there is a person standing still, i.e. that it is highly probable that there is a person who intends to pass through the door opening 10, Step 22 is executed, and a signal indicative of presence of a person wanting to pass through the door opening 10 is outputted to the automatic door controller 34. Accordingly, if the person is standing still at a location outside the predetermined area, for example, a location other than a location near the door panels 12, 12, it is judged that there is no person intending to pass through the door opening 10, and the door panels 12, 12 are never opened, whereby the burden on the environment is reduced.

Figure 18:
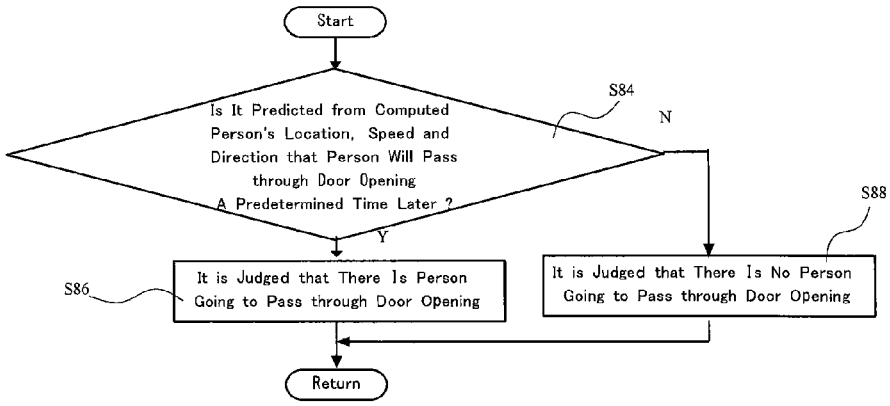
FIG. 18 is a flow chart illustrating the processing executed by person's movement judging means 44 shown in FIG. 4.

If, in Step S72, it is judged that there is no person halting, person's movement judging means 44 in the arithmetic unit 28 makes a judgment whether there is a person moving (Step S82). More specifically, as shown in FIG. 18, it is judged, from the computed person's location and the speed and direction of movement, whether it is probable for the person of interest to pass through the door opening a predetermined time later (Step S84). If the judgment is YES, it is judged that there is a person who is intending to pass through the door opening (Step S86), and the processing is ended. If the answer to the judgment is NO, it is judged that there is no person going to pass through the door opening (Step S88), and the processing is ended.

If it is judged that there is no person who is going to pass through the door opening in Step S82, Step S2 is executed again. If, on the other hand, it is judged in Step S82, that there is a person who intends to pass through the door opening, Step S22 is executed and a signal indicative of the presence of a person going to pass through the door opening is outputted to the automatic door controller 34, and, after that, Step S2 is executed again. As described, only when it is predicted that a person is going to pass through the door opening a predetermined time later, the door panels 12, 12 are opened. Accordingly, even if there is a person moving toward the fixed wall 8, for example, it never happens that the door panels 12, 12 are opened.

In the described embodiment, the two door panels 12, 12 slide toward the fixed walls 8, 8 or toward the center of the door opening 10. However, only one door panel may be used, which is arranged to slide from one of the fixed walls 8, 8, toward the other to close the door opening, and to slide from the other fixed wall 8, where the door opening is closed, toward the one to open the door opening. Further, in the above-described embodiment, each of the light-emitter unit 16 and the light-receiver unit 18 has been described as including the light-emitting devices or the light-receiving device smaller in number than the detection spots, but they may be constructed to be formed of the light-emitting and light-receiving devices equal in number to the detection spots. The detecting unit 14 has been described as including the light-emitter unit 16 and the light-receiver unit 18, but it may be formed only of a light-receiver unit including pyroelectric sensors as the light-receiving devices, which pyroelectric sensors receiving infrared light emitted from a human body or the like. In the described embodiment, the spot determining means 32 is used, but it may be removed, depending on the situations. The embodiment has been described as being in such a situation where the door is opened, but, needless to say, the invention is effective under a condition where the door is open. In this case, as long as a person going to pass through the door opening is present, the door is kept open, but, in case that there is only a person who is passing by the door, the door starts its closing operation. The detecting unit 14 and the arithmetic unit 28 may be housed in one casing. Alternatively, they can be independently housed and exchange a variety of information, such as detection command and detection information, via a data bus, e.g. a CAN bus. In such a case, it is possible to arrange such that the detecting unit 14 only is made exposed with the arithmetic unit 28 placed inside the lintel 6, and, therefore, the automatic door sensor 2 is inconspicuous, and adverse effect on the appearance of the door can be minimized. Furthermore, in this case, by adding a function to provide, from the detecting unit 14 to the automatic door controller, a result of object detection judgment made by the object detecting means 26 with respect to each of the detection spots, the detecting unit 14 can be used both for an application where there is no need to find the direction etc. of movement of a person, but only the presence of a person need be detected, and for an application where the direction etc. of movement of a person must also be found like the present invention. This can simplify the stock control etc. Further, it is possible to install only the detecting unit 14 and to add the arithmetic unit 28 afterwards when it becomes necessary, which makes it easy to deal with changes in environments of installation, such as the amount of traffic, and, in addition, there is no need to dismount the existing automatic door sensor and abandon it. Thus, influence on the global environment an be minimized.

The invention claimed is:

1. A sensor for use with an automatic door, comprising:

detecting means forming a plurality of detection spots arranged two-dimensionally on a floor surface near a door, each of said detection spots being capable of detecting a person or an object by means of infrared light independently from other detection spots;

distinguishing means distinguishing a region formed by a plurality of adjacent ones of said detection spots detecting said person or object;

judging means judging a direction in which said distinguished region moves; and output means outputting a signal which causes said door to be opened only when the direction of movement of said distinguished region is a direction toward said door;

wherein:

said judging means computes the direction of movement of said distinguished region on the basis of a location of the center of gravity of said distinguished region; and the center of gravity of said distinguished region is the centroid of said distinguished region offset toward said detecting means by a predetermined amount.

2. The sensor according to claim 1, wherein:

when there are a plurality of said distinguished regions, said distinguishing means distinguishes respective ones of said regions independently;

said judging means judges independently the directions in which said plurality of distinguished regions move; and said output means outputs said signal which causes said door to be opened when the direction of movement of any one of said independently distinguished regions is the direction toward said door.

3. The sensor according to claim 1, wherein said output means outputs said signal which causes said door to be opened when it can be predicted, on the basis of the location of the center of gravity of said distinguished region and a velocity of movement of said location of the center of gravity as computed on the basis of the change of said location of the center of gravity with time, that said location of the center of gravity of said distinguished region will pass through an opening of said door within a predetermined time.

4. The sensor according to claim 1, wherein said output means outputs said signal which causes said door to be opened when the location of the center of gravity of said distinguished region is halting within a predetermined area close to said door.

5. The sensor according to claim 1, wherein said output means outputs said signal which causes said door to be opened when the location of the center of gravity of said distinguished region is within a predetermined area close to said door.

6. The sensor according to claim 4, wherein said predetermined area is preset according to the width of said door opening.

7. The sensor according to claim 5, wherein said predetermined area is preset according to the width of said door opening.

* * * * *